US011460032B2

(12) United States Patent
Hu et al.

(10) Patent No.: US 11,460,032 B2
(45) Date of Patent: Oct. 4, 2022

(54) CROSS-FLOW IMPELLER MOUNTING STRUCTURE, AIR DUCT COMPONENT AND APPARATUS HAVING CROSS-FLOW IMPELLER

(71) Applicants: GREE ELECTRIC APPLIANCES (WUHAN) CO., LTD, Wuhan (CN); GREE ELECTRIC APPLIANCES, INC. OF ZHUHAI, Zhuhai (CN)

(72) Inventors: Xiaobo Hu, Zhuhai (CN); Tuchun Sun, Zhuhai (CN); Jianfei Hou, Zhuhai (CN); Hai Yang, Zhuhai (CN); Yabo Hu, Zhuhai (CN); Zhiyong Jiang, Zhuhai (CN); Li Zeng, Zhuhai (CN); Bowen Zheng, Zhuhai (CN)

(73) Assignees: GREE ELECTRIC APPLIANCES (WUHAN) CO., LTD, Wuhan (CN); GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 39 days.

(21) Appl. No.: 16/637,764

(22) PCT Filed: Aug. 20, 2018

(86) PCT No.: PCT/CN2018/101349
§ 371 (c)(1),
(2) Date: Feb. 10, 2020

(87) PCT Pub. No.: WO2019/076127
PCT Pub. Date: Apr. 25, 2019

(65) Prior Publication Data

US 2020/0248705 A1 Aug. 6, 2020

(30) Foreign Application Priority Data

Oct. 19, 2017 (CN) ..... 201710976985.5

(51) Int. Cl.
*F04D 17/04* (2006.01)
*F04D 25/08* (2006.01)
(Continued)

(52) U.S. Cl.
CPC ..... *F04D 17/04* (2013.01); *F04D 25/06* (2013.01); *F04D 25/08* (2013.01);
(Continued)

(58) Field of Classification Search
CPC . F04D 5/00; F04D 17/04; F04D 25/06; F04D 25/08; F04D 29/4226; F04D 29/582; F04D 29/624; F04D 29/626
(Continued)

(56) References Cited

U.S. PATENT DOCUMENTS 3,219,261 A * 11/1965 Laing ..... F04D 25/022 415/53.1
3,251,540 A * 5/1966 Kinsworthy ..... F24F 1/0073 415/207
(Continued)

FOREIGN PATENT DOCUMENTS

CN 1869453 A 11/2006
CN 201203211 Y * 3/2009 ..... F04D 29/626
(Continued)

*Primary Examiner* — Kenneth J Hansen
*Assistant Examiner* — David N Brandt
(74) *Attorney, Agent, or Firm* — Kilpatrick Townsend & Stockton, LLP

(57) ABSTRACT

A cross-flow impeller mounting structure includes a housing and an impeller shaft support structure mounted on the housing and adapted to mount and support one end of a cross-flow impeller shaft away from a motor; the housing is adapted to mount a cross-flow impeller and match the cross-flow impeller to form an air duct; the housing includes: a side wall; a first end wall connected to one end of the side wall and provided with a first mounting through
(Continued)

hole having an aperture which matches an outer diameter of the motor driving the cross-flow impeller to rotate and is adapted to mount the motor; a second end wall connected to the other end of the side wall and provided with a second mounting through hole for the cross-flow impeller to mount; the second end wall, the first end wall and the side wall encloses a cavity receiving the cross-flow impeller.

15 Claims, 5 Drawing Sheets

(51) Int. Cl.
*F04D 29/62* (2006.01)
*F04D 29/42* (2006.01)
*F04D 25/06* (2006.01)
*F04D 29/58* (2006.01)

(52) U.S. Cl.
CPC ..... *F04D 29/4226* (2013.01); *F04D 29/624* (2013.01); *F04D 29/582* (2013.01)

(58) Field of Classification Search
USPC ..... 415/53.1, 119; 416/244 R, 500; 417/423.7, 423.12, 423.14, 423.15, 424.1, 417/424.2
See application file for complete search history.

(56) References Cited

U.S. PATENT DOCUMENTS 3,258,195 A * 6/1966 Laing ..... F04D 17/04 415/53.3
3,260,442 A * 7/1966 Laing ..... F04D 25/082 415/53.1
3,279,209 A * 10/1966 Laing ..... F24F 1/035 62/426
3,322,331 A * 5/1967 Kenny ..... F04D 17/04 417/423.14
3,664,349 A * 5/1972 Quick ..... A01F 12/444 460/99
3,680,974 A * 8/1972 Smith ..... F04D 17/04 415/53.1
3,857,189 A * 12/1974 Katayama ..... G03G 15/11 34/95
4,014,625 A * 3/1977 Yamamoto ..... F04D 17/04 415/53.1
4,754,697 A * 7/1988 Asselbergs ..... F24H 3/0417 236/49.3
4,859,888 A * 8/1989 Ohbayashi ..... F04D 25/0606 310/68 R
5,266,004 A * 11/1993 Tsumurai ..... F04D 29/703 415/121.2
5,308,224 A * 5/1994 Olivero ..... F04D 29/668 415/119
5,599,162 A * 2/1997 Ricketts ..... A01F 12/444 415/53.1
5,803,707 A * 9/1998 Schips ..... F04D 17/04 415/213.1
6,047,765 A * 4/2000 Zhan ..... H01L 23/467 165/121
6,210,101 B1 * 4/2001 Horng ..... F04D 17/04 415/203
7,566,262 B2 * 7/2009 Hu ..... F24F 7/007 454/284
7,568,884 B2 * 8/2009 Fok ..... F04D 29/462 415/125
7,664,378 B2 * 2/2010 Gao ..... F04D 29/582 392/360
8,007,225 B2 * 8/2011 Ko ..... F04D 17/04 415/53.1
8,177,485 B2 * 5/2012 Ko ..... F04D 29/626 415/119
8,272,853 B2 * 9/2012 Ko ..... F04D 25/0606 417/423.15
10,132,514 B2 * 11/2018 Hu ..... F24F 13/082
2005/0140233 A1 * 6/2005 Kojima ..... F04D 25/0653 310/156.37
2006/0233638 A1 * 10/2006 Chen ..... F04D 29/582 415/53.1
2010/0015905 A1 * 1/2010 Hu ..... F24F 13/082 454/258
2010/0153664 A1 6/2010 Ko
2014/0175912 A1 * 6/2014 Germann ..... H02K 3/522 310/43
2015/0024675 A1 * 1/2015 Hu ..... F24F 7/065 454/258

FOREIGN PATENT DOCUMENTS

CN 201203211 Y 3/2009
CN 202991545 U 6/2013
CN 204610386 U 9/2015
CN 107701518 A 2/2018
CN 207526775 U 6/2018
JP H0323392 A 1/1991
JP H09317691 A 12/1997
JP H11132493 * 5/1999
JP H11132493 A 5/1999
JP 2017089607 A 5/2017

* cited by examiner

CROSS-FLOW IMPELLER MOUNTING STRUCTURE, AIR DUCT COMPONENT AND APPARATUS HAVING CROSS-FLOW IMPELLER

CROSS-REFERENCES TO RELATED APPLICATIONS

This application is a U.S. National Stage of International Application No. PCT/CN2018/101349, filed on Aug. 20, 2018, which claims the benefit of the priority of Chinese Patent Application No. 201710976985.5, filed on Oct. 19, 2017, entitled "Cross-Flow Impeller Mounting Structure, Air Duct Component and Apparatus Having Cross-Flow Impeller", and the entire content of each of which is incorporated herein by reference.

TECHNICAL FIELD

The present disclosure relates to the technical field of household appliances, and particularly to a cross-flow impeller mounting structure, an air duct component and an apparatus having a cross-flow impeller.

BACKGROUND

Cross-flow impellers are widely used in air conditioners and various fans because of the advantages of a smooth air flow, a high dynamic pressure coefficient, a longer distance to reach, and a low noise.

The air duct component of the cross-flow impeller includes a housing configured to mount the cross-flow impeller, a cross-flow impeller mounted on the housing, and a motor mounted at an end portion of the housing and configured to drive the cross-flow impeller to rotate. An air duct is formed between an inner wall and the cross-flow impeller. In the existing cross-flow impeller and air duct component, the housing includes an unclosed side wall and end walls connected to both ends of the side wall, and the side wall and the two end walls enclose a cavity capable of receiving the cross-flow impeller. The end wall at one end is provided with a first opening having a diameter larger than the outer diameter of the cross-flow impeller and configured to mount the cross-flow impeller. The end wall on the other end is provided with no opening or provided with a second opening having a diameter much smaller than the outer diameter of the cross-flow impeller and only configured to mount an impeller bearing fixing seat. Thus, the cross-flow impeller and the motor can only be mounted through the first opening.

As for the above-mentioned existing cross-flow impeller and air duct component, it is impossible to directly mount and fix the motor because of the larger diameter of the first opening. Therefore, when mounting the cross-flow impeller and the motor, an asynchronous motor and a sheet-metal fixing frame are usually fixed by using screws first; then the cross-flow impeller is fixed to the motor shaft of the asynchronous motor, and then the asynchronous motor, sheet-metal fixing frame and the cross-flow impeller which have been assembled as a whole together pass through one end of the air duct component to well align with the impeller bearing fixing seat at the other end; and the sheet-metal fixing frame is connected to the air duct through screws to complete the assembly. In this assembly process, the motor itself is heavier together with heavier sheet-metal fixing frame and cross-flow impeller, such that it is relatively difficult to mount the motor, the cross-flow impeller and the sheet-metal fixing frame as a whole onto the housing; meanwhile, the motor is connected to the housing by mean of a sheet-metal fixing frame, the added sheet-metal fixing frame apparatus makes it difficult to guarantee concentricity of the cross-flow impeller. If the concentricity is low, which easily leads to that the noise value in the operation process of the entire machine becomes large, and disadvantages such as joggling, shaking, and abnormal noise that affect the overall performance may arise.

SUMMARY

In view of this, the technical problem to be solved by the present disclosure is the disadvantages of greater difficulty in mounting the motor and the cross-flow impeller and difficulty in ensuring the concentricity of the cross-flow impeller for the cross-flow impeller and the air duct component in the prior art. In order to address the above problem, a cross-flow impeller mounting structure, an air duct component and an apparatus having a cross-flow impeller are provided to facilitate the mounting of the cross-flow impeller and the motor, and guarantee a higher concentricity of the cross-flow impeller.

The present disclose provides a cross-flow impeller mounting structure including a housing and an impeller shaft support structure which is mounted on the housing and is adapted to mount and support one end of a cross-flow impeller shaft away from a motor; the housing (1) being adapted to mount a cross-flow impeller (4) and match the cross-flow impeller to form an air duct; the housing includes:

- a side wall;
- a first end wall, connected to one end of the side wall and provided with a first mounting through hole having an aperture which matches an outer diameter of the motor driving the cross-flow impeller to rotate and is adapted to mount the motor;
- a second end wall, connected to the other end of the side wall and provided with a second mounting through hole for loading the cross-flow impeller; the second end wall, the first end wall and the side wall enclosing a cavity receiving the cross-flow impeller.

The side wall, the first end wall and the second end wall are formed in one.

The impeller shaft support structure includes:

- an air duct cover plate, detachably and fixedly connected to the second mounting through hole and configured to seal the second mounting through hole; the air duct cover plate being provided with a third mounting through hole at a position corresponding to the cross-flow impeller shaft;
- an impeller bearing fixing seat mounted in the third mounting through hole; the impeller bearing fixing seat rotatably supporting the cross-flow impeller shaft.

An outer peripheral wall of the impeller bearing fixing seat is provided with a rubber part which is in interference fit with the third mounting through hole, and the impeller bearing fixing seat is detachably mounted in the third mounting through hole through the rubber part.

An outer diameter of the air duct cover plate is larger than an aperture of the second mounting through hole; an end surface of the second end wall extends inward in an axial direction to form a yielding groove which is concentric with the second mounting through hole and is adapted to embed the air duct cover plate; the air duct cover plate is fixedly connected to a groove bottom of the yielding groove.

The air duct cover plate is connected to the groove bottom of the yielding groove through a threaded fastener.

A cross-sectional shape of the yielding groove matches a cross-sectional shape of the air duct cover plate, and a diameter of the yielding groove matches the outer diameter of the air duct cover plate.

A motor end cover is fixedly mounted on an outer side of the motor, and the motor end cover is fixedly connected to the first end wall.

The motor end cover is connected to the first end wall through a threaded fastener.

The present disclosure further provides an air duct component including the above-mentioned cross-flow impeller mounting structure, the cross-flow impeller and the motor.

The present disclosure further provides an apparatus having a cross-flow impeller, which includes the above-mentioned air duct component.

The apparatus having the cross-flow impeller is a cooling fan.

The technical solution of the present disclosure has the following advantages.

1. As for the cross-flow impeller mounting structure provided by the present disclosure, through providing a first mounting through hole on the first end wall of the housing, the aperture of the first mounting through hole that matching the outer diameter of the motor that drives the cross-flow impeller to rotate and being adapted to mount the motor, and providing the second mounting through hole on the second end wall of the housing for the cross-flow impeller to mount, it would be possible to implement the mounting of the cross-flow impeller into the housing from the second end wall and the mounting of the motor into the housing from the first end wall, i.e., it would be possible to implement the mounting of the motor and the cross-flow impeller respectively from different end walls, thereby not only avoiding the problem of greater difficulty in mounting the motor and the cross-flow impeller caused by the overweight motor and cross-flow impeller as a whole, but also making the first mounting through hole for mounting the motor no longer need to be made into a large aperture capable of mounting the cross-flow impeller, that is, the aperture size can be reduced as long as the aperture size can be adapted to the motor. In this way, the motor can be directly fixedly connected to the first end wall, and then the need for a sheet-metal fixing frame to obtain an aperture adapted to mount the motor can be eliminated, thereby not only reducing the assembly weight, but also reducing the number of the structures needing to be assembled, and improving the assembly efficiency. Meanwhile, since the sheet-metal fixing frame can be omitted at the motor end as a high-speed end, accordingly the motor can be directly mounted on the first end wall, thereby effectively ensuring that the cross-flow impeller has a higher concentricity 2. As for the cross-flow impeller mounting structure provided by the present disclosure, the side wall, the first end wall and the second end wall are formed in one, which can not only improve the assembly efficiency and strength, but also make the concentricity of the cross-flow impeller more guaranteed.

3. As for the cross-flow impeller mounting structure provided in the present disclosure, a rubber part is provided on an outer peripheral wall of the impeller bearing fixing seat and is in interference fit with the third mounting through hole; the impeller bearing fixing seat is detachably mounted in the third mounting through hole through the rubber part, in this way, the impeller bearing fixing seat can be directly mounted into the third mounting through hole only by squeezing the rubber part to deform the rubber part without the screw fixation. Therefore, the mounting is convenient and quick.

4. As for the cross-flow impeller mounting structure provided by the present disclosure, an outer diameter of the air duct cover plate is greater than an aperture of the second mounting through hole; an end surface of the second end wall extends inwardly in an axial direction to form a yielding groove which is concentric with the second mounting through hole and is adapted to embed the air duct cover plate; and the air duct cover plate is fixedly connected to the groove bottom of the yielding groove. The arrangement of the yielding groove not only facilitates the mounting of the air duct cover plate on the second end wall of the housing, but also makes the mounting of the air duct cover plate on the second end wall more stable.

BRIEF DESCRIPTION OF THE DRAWINGS

In order to illustrate the embodiments of the present disclosure or the technical solutions in the prior art more clearly, the accompanying drawings used in the embodiments or the description of the prior art will be briefly introduced below. Apparently, the accompanying drawings referred to in the following description are some embodiments of the present disclosure, and it would be possible for those skilled in the art to obtain other drawings based on these drawings without any creative work.

REFERENCE SIGNS DESCRIPTION

Figure 1:
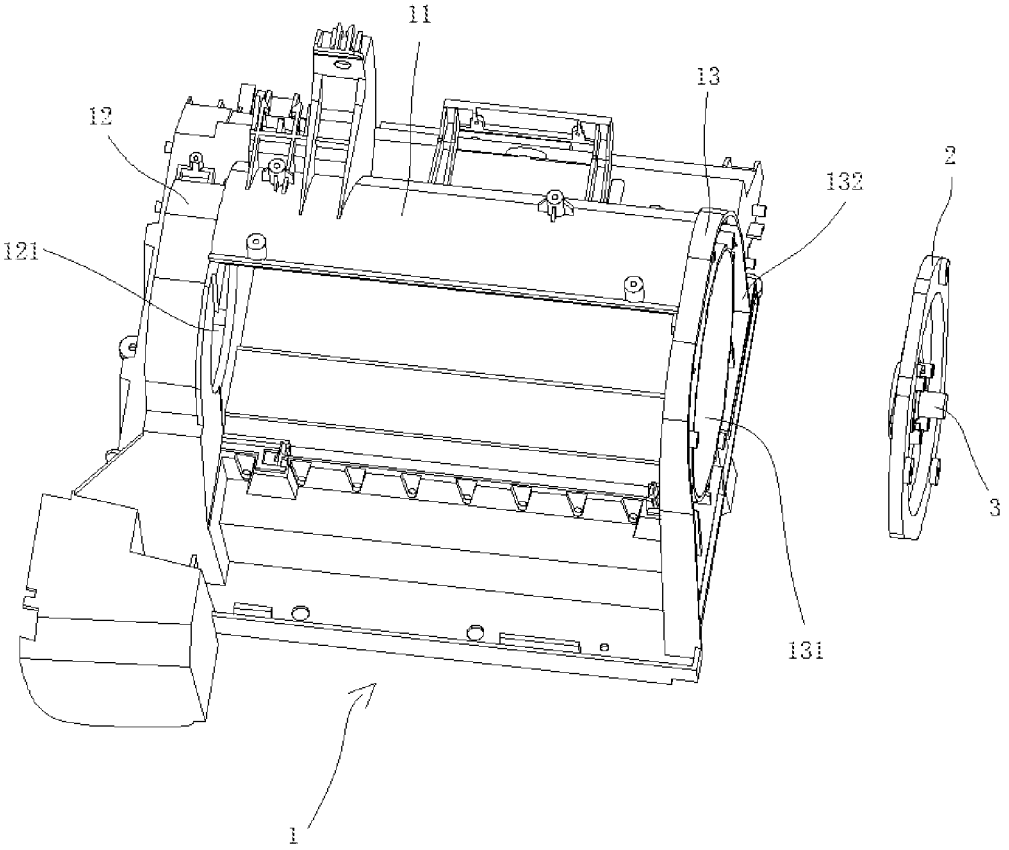
FIG. 1 is a schematic stereoscopic exploded view of a cross-flow impeller mounting structure provided by Embodiment I of the present disclosure.
Figure 2:
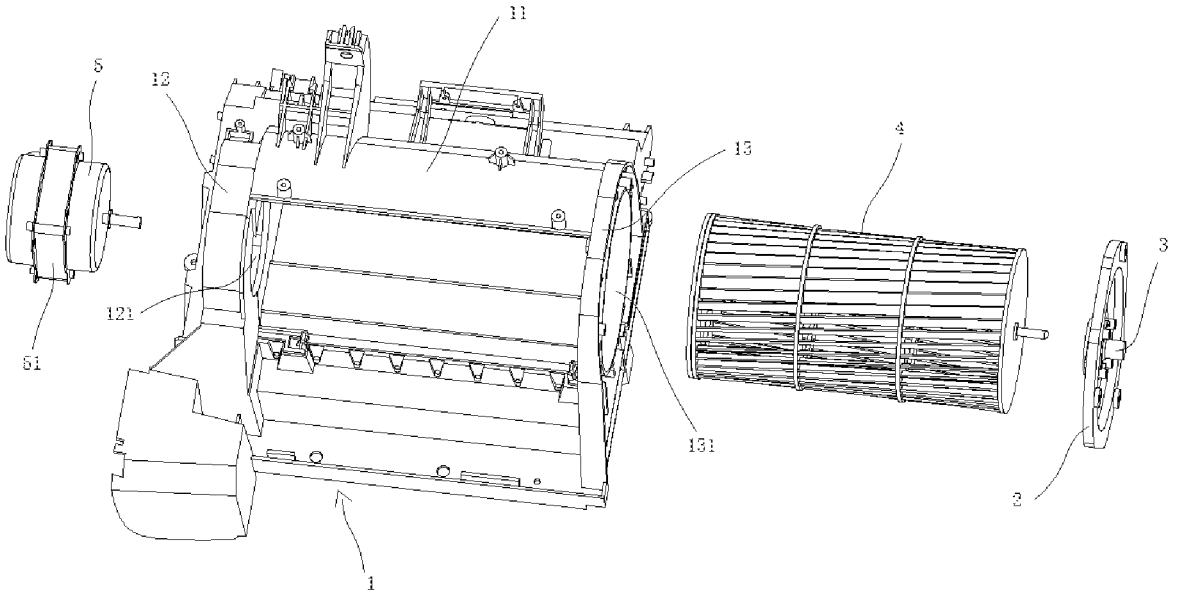
FIG. 2 is a schematic stereoscopic exploded view of an air duct component provided by Embodiment II of the present disclosure.
Figure 3:
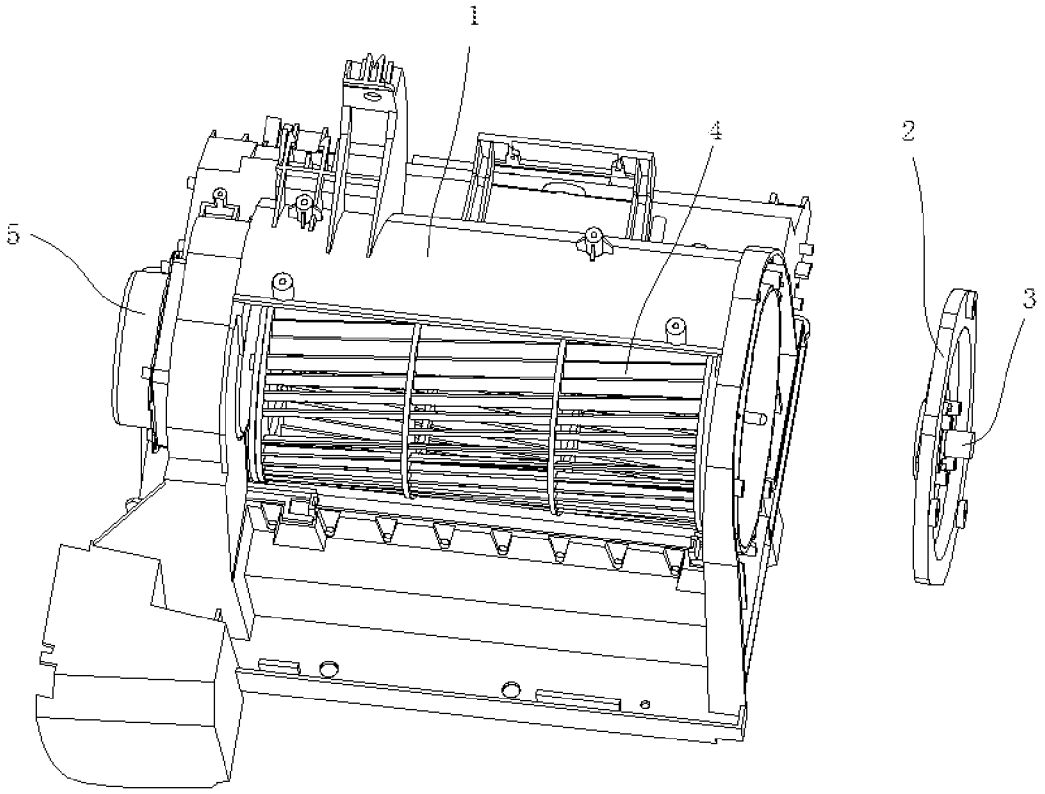
FIG. 3 is a schematic diagram showing a state in which an impeller shaft support structure of the air duct component shown in FIG. 2 is not mounted to a housing.
Figure 4:
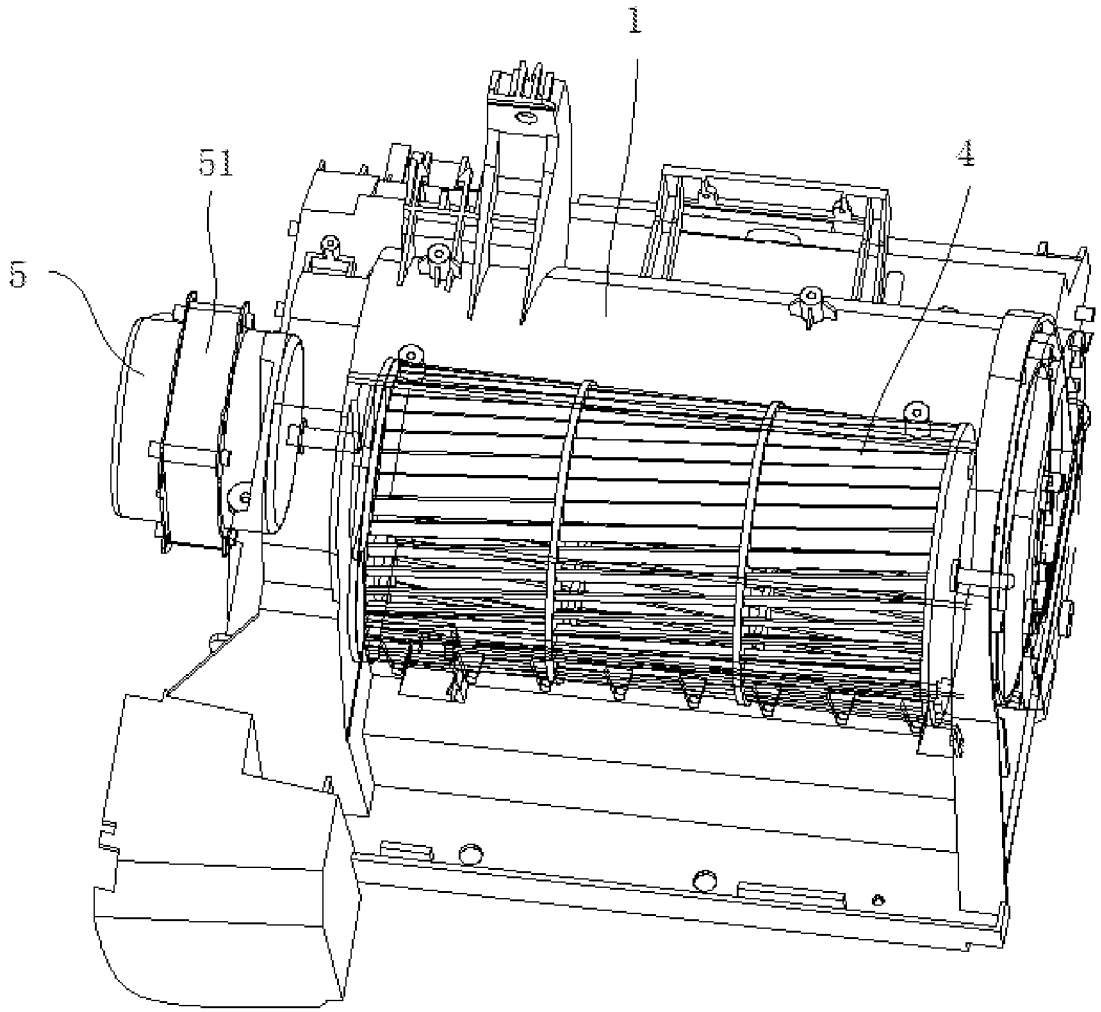
FIG. 4 is a schematic stereoscopic assembly diagram of the air duct component shown in FIG. 2.

1, housing; 11, side wall; 12, first end wall; 121, first mounting through hole; 13, second end wall; 131, second mounting through hole; 132, yielding groove; 2, air duct cover plate; 21, third mounting through hole; 3, impeller bearing fixing seat; 4, cross-flow impeller; 5, motor; 51, motor end cover.

DETAILED DESCRIPTION OF THE INVENTION

The technical solution of the present disclosure will be clearly and completely described below with reference to the accompanying drawings. Apparently, the described embodiments are a part of the embodiments of the present disclosure, not all the embodiments. Based on the embodiments in the present disclosure, all other embodiments obtained by those skilled in the art without creative work shall fall within the scope of protection of the present disclosure.

In addition, the technical features involved in different embodiments of the present disclosure described below can be combined with each other as long as they do not conflict with each other.

EXAMPLE I

As shown in FIGS. 1 to 4, a cross-flow impeller mounting structure, provided by the present embodiment, includes a housing 1 and an impeller shaft support structure which is mounted on one end of the housing 1 away from a motor 5 and is adapted to mount and support an cross-flow impeller shaft.

The housing 1 is adapted to mount a cross-flow impeller 4 and match the cross-flow impeller 4 to form an air duct. The housing 1 includes a side wall 11, a first end wall 12 and a second end wall 13.

The first end wall 12 is connected to one end of the side wall 11 and is provided with a first mounting through hole 121. The first mounting through hole 121 has an aperture matching an outer diameter of the motor 5 which drives the cross-flow impeller 4 to rotate, and the aperture is adapted to mount the motor 5.

The second end wall 13 is connected to the other end of the side wall 11 and is provided with a second mounting through hole 131 for loading the cross-flow impeller 4. The second end wall 13, the first end wall 12 and the side wall 11 can enclose a cavity capable of receiving the cross-flow impeller 4.

In order to improve the assembly efficiency and strength, and at the same time to guarantee the concentricity of the cross-flow impeller 4, in the present embodiment, the side wall 11, the first end wall 12 and the second end wall 13 are formed in one. As an alternative embodiment, the side wall 11, the first end wall 12 and the second end wall 13 may be formed separately.

Figure 5:
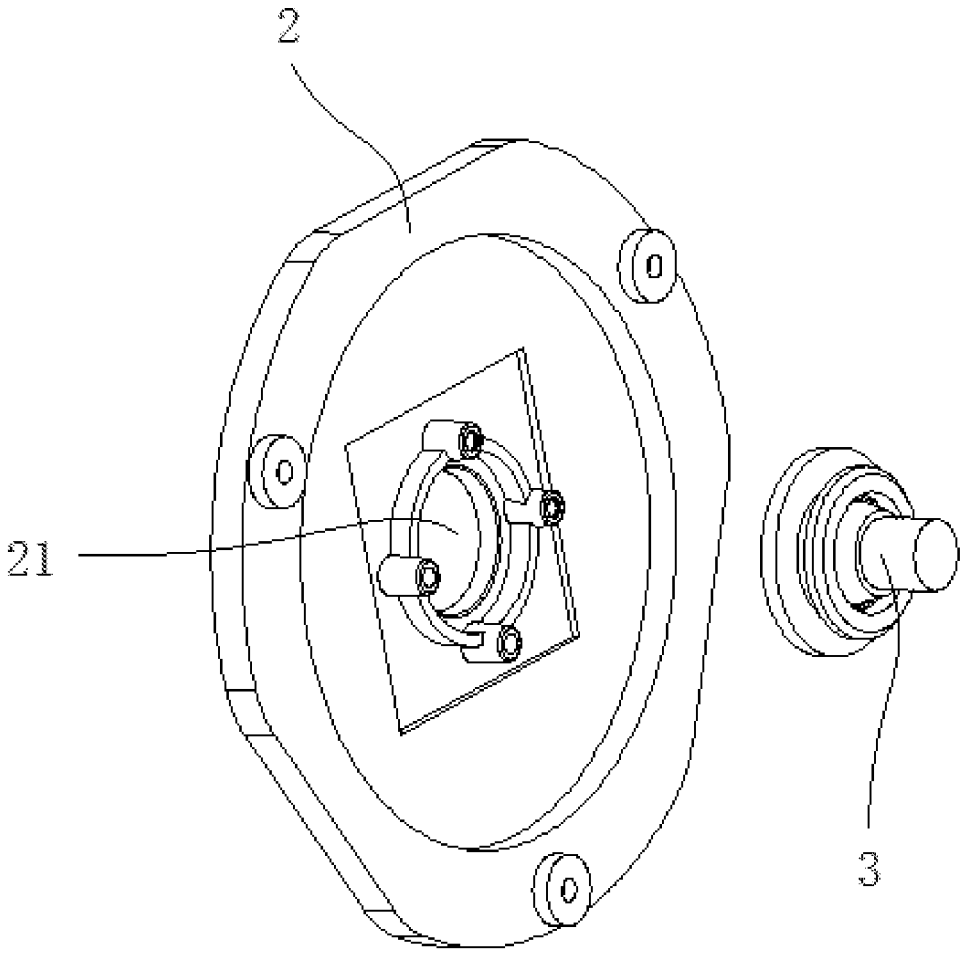
FIG. 5 is a schematic structure diagram of the impeller shaft support structure provided by FIG. 1.

The impeller shaft support structure may have a variety of specific forms. In the present embodiment, referring to FIG. 5, the impeller shaft support structure may include:

an air duct cover plate 2 which is detachably and fixedly connected to the second mounting through hole 131 and configured to seal the second mounting through hole 131; the air duct cover plate 2 being provided with a third mounting through hole 21 at a position corresponding to the cross-flow impeller shaft;

an impeller bearing fixing seat 3 which is mounted in the third mounting through hole; the impeller bearing fixing seat 3 rotatably supporting the cross-flow impeller shaft.

In the present embodiment, the outer peripheral wall of the impeller bearing fixing seat 3 is provided with a rubber part which is in interference fit with the third mounting through hole, and the impeller bearing fixing seat 3 is detachably mounted in the third mounting through hole through the rubber part. In this way, the impeller bearing fixing seat 3 can be directly mounted into the third mounting through hole only by squeezing the rubber part to deform the rubber part without the screw fixation. Therefore, the mounting is convenient and quick.

The outer diameter of the air duct cover plate 2 is larger than the aperture of the second mounting through hole 131, and the end surface of the second end wall 13 extends inward in the axial direction to form an yielding groove which is concentric with the second mounting through hole 131 and adapted to embed the air duct cover plate 2. The air duct cover plate 2 is fixedly connected to a groove bottom of the yielding groove 132. The arrangement of the yielding groove 132 not only facilitates the mounting of the air duct cover 2 on the second end wall 13 of the housing 1, but also makes the mounting of the air duct cover 2 on the second end wall 13 more stable.

The air duct cover 2 is connected to the groove bottom of the yielding groove 132 through a threaded fastener.

The cross-sectional shape of the yielding groove 132 matches the cross-sectional shape of the air duct cover 2, and the diameter of the yielding groove 132 matches the outer diameter of the air duct cover 2.

A motor end cover 51 is fixedly mounted on the outer side of the motor 5, and the motor end cover 51 is fixedly connected to the first end wall 12.

The motor end cover 51 is connected to the first end wall 12 through a threaded fastener.

The threaded fasteners in the present embodiment are all screws. As an alternative embodiment, the threaded fastener may also be a bolt, a stud, or the like.

When assembling, firstly the motor 5 is mounted into the housing 1 through the first mounting through hole 121 of the first end wall 12 of the housing 1, and the motor end cover 51 is fixedly connected to the first end wall 12 of the housing 1 through a screw; then the cross-flow impeller 4 is mounted into the housing 1 through the second mounting through hole 131 of the second end wall 13 of the housing 1 and is aligned with the motor 5 shaft, and the motor 5 shaft is fixedly connected to the cross-flow impeller 4 through a screw; the impeller bearing fixing seat 3 is mounted into the third mounting through hole of the air duct cover plate 2 by squeezing the rubber part on the impeller bearing fixing seat 3 in advance; then the impeller bearing fixing seat 3 and the air duct cover plate 2 which are pre-assembled as a whole are embedded in the yielding groove 132 of the second end wall 13, and in this process, it is guaranteed that the impeller bearing fixing seat 3 is aligned with the shaft of the cross-flow impeller 4; and finally the air duct cover plate 2 is connected to the groove bottom of the yielding groove 132 through a screw, to complete the assembly of the cross-flow impeller 4, the motor 5 and the housing 1.

In the present embodiment, the first end wall 12 of the housing 1 is provided with a first mounting through hole 121 which has an aperture matching the outer diameter of the motor 5 which drives the cross-flow impeller 4 to rotate, and the aperture is adapted to mount the motor 5. The second end wall 13 of the housing 1 is provided with a second mounting through hole 131 for loading the cross-flow impeller 4. In such way it would be possible to implement the mounting of the cross-flow impeller 4 into the housing 1 from the second end wall 13 and the mounting of the motor 5 into the housing 1 from the first end wall 12, i.e., it would be possible to implement the mounting of the motor 5 and the cross-flow impeller 4 respectively from different end walls, thereby not only avoiding the problem of greater difficulty in mounting the motor 5 and the cross-flow impeller 4 caused by the overweight motor 5 and cross-flow impeller 4 as a whole, but also making the first mounting through hole 121 for mounting the motor 5 no longer need to be made into a large aperture capable of mounting the cross-flow impeller 4, that is, the aperture size can be reduced as long as the aperture size can be adapted to the motor 5. In this way, the motor 5 can be directly fixedly connected to the first end wall 12, and then the need for a sheet-metal fixing frame to obtain an aperture adapted to mount the motor 5 can be eliminated, thereby not only reducing the assembly weight, but also reducing the number of the structures needing to be assembled, and improving the assembly efficiency. Meanwhile, since the sheet-metal fixing frame can be omitted at the motor 5 end as a high-speed end, accordingly the motor 5 can be directly mounted on the first end wall 12, thereby effectively ensuring that the cross-flow impeller 4 has a higher concentricity.

EXAMPLE II

The present embodiment provides an air duct component which includes the cross-flow impeller mounting structure and the cross-flow impeller 4 and the motor 5 described in the example I.

EXAMPLE III

The present embodiment provides an apparatus having a cross-flow impeller 4. The apparatus includes the air duct component described in the example II. In the present embodiment, the apparatus having the cross-flow impeller 4 is a cooling fan, specifically, an evaporative cooling fan.

Apparently, the above-mentioned embodiments are merely examples for clear description, and are not intended to constitute a limitation on the implementation manner. Those skilled in the art can make other different forms of changes or modifications based on the above description. There is no need or no way to exhaust all the embodiments. However, the apparent changes or modifications derived thereby are still within the scope of protection of the present disclosure.

The invention claimed is:

1. A mounting structure for a cross-flow impeller, comprising a housing and an impeller shaft support structure which is mounted on the housing and is adapted to mount and support one end of a cross-flow impeller shaft opposite from a motor, the housing being adapted to mount the cross-flow impeller and fit the cross-flow impeller to form an air duct, wherein, the housing comprises: a side wall; a first end wall, connected to a first end of the side wall and provided with a first mounting through hole having a hole diameter which has a diameter larger than an outer diameter of the motor driving the cross-flow impeller to rotate and which is adapted to mount the motor; a second end wall, connected to a second end of the side wall and provided with a second mounting through hole for mounting the cross-flow impeller; the second end wall, the first end wall and the side wall enclosing a cavity receiving the cross-flow impeller; wherein the hole diameter of the first mounting through hole is reduced relative to a hole diameter of the second mounting through hole, wherein, the impeller shaft support structure comprises: an air duct cover plate, detachably and fixedly connected to the second mounting through hole and configured to seal the second mounting through hole; the air duct cover plate being provided with a third mounting through hole at a position corresponding to the cross-flow impeller shaft; an impeller bearing fixing seat mounted in the third mounting hole; the impeller bearing fixing seat rotatably supporting the cross-flow impeller shaft; wherein, an outer diameter of the air duct cover plate is larger than the hole diameter of the second mounting through hole; an end surface of the second end wall extends in an axial direction to form a yielding groove which is concentric with the second mounting through hole and is adapted to embed the air duct cover plate; the air duct cover plate is fixedly connected to a groove bottom of the yielding groove.

2. The mounting structure according to claim 1, wherein, the side wall, the first end wall and the second end wall are formed in one piece.

3. The mounting structure according to claim 1, wherein, an outer peripheral wall of the impeller bearing fixing seat is provided with a rubber part which is in interference fit with the third mounting hole, and the impeller bearing fixing seat is detachably mounted in the third mounting hole through the rubber part.

4. The mounting structure according to claim 1, wherein, the air duct cover plate is connected to the groove bottom of the yielding groove through a threaded fastener.

5. The mounting structure according to claim 1, wherein, a cross-sectional shape of the yielding groove is the same as a cross-sectional shape of the air duct cover plate, and a diameter of the yielding groove is less than the outer diameter of the air duct cover plate.

6. The mounting structure according to claim 1, wherein, a motor end cover is fixedly mounted on an outer side of the motor, and the motor end cover is fixedly connected to the first end wall.

7. The mounting structure according to claim 6, wherein, the motor end cover is connected to the first end wall through a threaded fastener.

8. An air duct component, comprising the mounting structure, the cross-flow impeller and the motor according to claim 1.

9. An apparatus, comprising the air duct component according to claim 8.

10. The apparatus according to claim 9, wherein, the apparatus is a cooling fan.

11. The mounting structure according to claim 2, wherein, a motor end cover is fixedly mounted on an outer side of the motor, and the motor end cover is fixedly connected to the first end wall.

12. The air duct component according to claim 8, wherein, the side wall, the first end wall and the second end wall are formed in one piece.

13. The air duct component according to claim 8, wherein, an outer peripheral wall of the impeller bearing fixing seat is provided with a rubber part which is in interference fit with the third mounting through hole, and the impeller bearing fixing seat is detachably mounted in the third mounting through hole through the rubber part.

14. The air duct component according to claim 8, wherein, the air duct cover plate is connected to the groove bottom of the yielding groove through a threaded fastener.

15. The air duct component according to claim 8, wherein, a cross-sectional shape of the yielding groove is the same as a cross-sectional shape of the air duct cover plate, and a diameter of the yielding groove is less than the outer diameter of the air duct cover plate.

* * * * *